US010774699B2

(12) United States Patent
Göransson

(10) Patent No.: US 10,774,699 B2
(45) Date of Patent: Sep. 15, 2020

(54) VALVE DRIVE

(71) Applicant: Scania CV AB, Södertälje (SE)

(72) Inventor: Hans Göransson, Älvsjö (SE)

(73) Assignee: Scania CV AB, Södertälje (SE)

( * ) Notice: Subject to any disclaimer, the term of this patent is extended or adjusted under 35 U.S.C. 154(b) by 0 days.

(21) Appl. No.: 16/096,250

(22) PCT Filed: Apr. 11, 2017

(86) PCT No.: PCT/SE2017/050354
§ 371 (c)(1),
(2) Date: Oct. 24, 2018

(87) PCT Pub. No.: WO2017/188877
PCT Pub. Date: Nov. 2, 2017

(65) Prior Publication Data

US 2019/0162086 A1 May 30, 2019

(30) Foreign Application Priority Data

Apr. 28, 2016 (SE) ..... 1650568

(51) Int. Cl.
*F01L 13/00* (2006.01)
*F02D 13/04* (2006.01)
(Continued)

(52) U.S. Cl.
CPC ..... *F01L 13/0036* (2013.01); *F01L 1/047* (2013.01); *F01L 1/053* (2013.01); *F01L 1/06* (2013.01);
(Continued)

(58) Field of Classification Search
CPC ..... F01L 1/047; F01L 1/08; F01L 1/18; F01L 1/181; F01L 1/20; F01L 1/053;
(Continued)

(56) References Cited

U.S. PATENT DOCUMENTS 3,884,198 A 5/1975 Ito
8,863,714 B1 10/2014 Moran et al.
(Continued)

FOREIGN PATENT DOCUMENTS

DE 4336593 A1 5/1994
DE 10241920 A1 3/2004
(Continued)

OTHER PUBLICATIONS

International Search Report for International Patent Application No. PCT/SE2017/050354 dated Jun. 8, 2017.
(Continued)

*Primary Examiner* — Devon C Kramer
*Assistant Examiner* — Kelsey L Stanek
(74) *Attorney, Agent, or Firm* — Moore & Van Allen PLLC; W. Kevin Ransom

(57) ABSTRACT

A valve drive comprising a camshaft with base shaft, a lobe pack mounted on the base shaft and comprising three cam lobes. Two actuator bodies are associated with two actuator pins each connected to a valve of a cylinder of the engine. The lobe pack is axially displaceable along the base shaft so as to for each actuator body change cam lobe aligned therewith. A middle cam lobe has a shape leaving an actuator body aligned therewith uninfluenced thereby. In a first position of the lobe pack a first of the actuator bodies is aligned with and hit and moved by a first cam lobe and the other, second actuator body is aligned with the middle cam lobe, and in a second position the second actuator body is aligned with and hit and moved by a third cam lobe and the first actuator body is aligned with the middle cam lobe.

17 Claims, 1 Drawing Sheet

(51) Int. Cl.

| | |
|---|---|
| ***F01L 1/053*** | (2006.01) |
| ***F01L 1/18*** | (2006.01) |
| ***F01L 13/06*** | (2006.01) |
| ***F01L 1/26*** | (2006.01) |
| ***F02D 13/06*** | (2006.01) |
| ***F01L 1/047*** | (2006.01) |
| ***F01L 1/06*** | (2006.01) |
| *F01L 1/20* | (2006.01) |

(52) U.S. Cl.
CPC ..... *F01L 1/181* (2013.01); *F01L 1/267* (2013.01); *F01L 13/065* (2013.01); *F02D 13/04* (2013.01); *F02D 13/06* (2013.01); *F01L 1/20* (2013.01); *F01L 2013/0052* (2013.01); *F01L 2013/10* (2013.01); *F01L 2305/00* (2020.05)

(58) Field of Classification Search
CPC ... F01L 1/267; F01L 13/0036; F01L 13/0042; F01L 2001/0473; F01L 2001/186; F01L 1/46; F01L 1/34413; F01L 13/0005; F01L 2013/0052; F01L 2800/06
USPC ..... 123/90.18, 90.16, 90.17, 90.27, 90.39, 123/90.44
See application file for complete search history.

(56) References Cited

U.S. PATENT DOCUMENTS

| | | | | |
|---|---|---|---|---|
| 2009/0038584 | A1* | 2/2009 | Schmid | F02D 13/0207 123/321 |
| 2010/0251982 | A1 | 10/2010 | Elendt et al. | |
| 2011/0079188 | A1* | 4/2011 | Meintschel | F01L 13/0036 123/90.15 |
| 2011/0126786 | A1* | 6/2011 | Kidooka | F01L 1/267 123/90.16 |
| 2012/0006292 | A1* | 1/2012 | Elendt | F01L 13/0036 123/90.18 |
| 2014/0318485 | A1* | 10/2014 | Stolk | F01L 1/34 123/90.15 |
| 2016/0298508 | A1 | 10/2016 | Lahr | |
| 2017/0122136 | A1* | 5/2017 | Yano | F01L 13/0036 |
| 2018/0142585 | A1* | 5/2018 | Lahr | F02D 13/04 |

FOREIGN PATENT DOCUMENTS

| | | | |
|---|---|---|---|
| DE | 102006005336 | A1 | 8/2007 |
| DE | 102008029325 | A1 | 12/2009 |
| DE | 102009030373 | A1 | 12/2010 |
| DE | 102013103553 | A1 | 10/2014 |
| DE | 102013019000 | A1 | 5/2015 |
| WO | 2008131992 | A1 | 11/2008 |

OTHER PUBLICATIONS

Written Opinion of the International Searching Authority for International Patent Application No. PCT/SE2017/050354 dated Jun. 8, 2017.

Scania CV AB, International Application No. PCT/SE2017/050354, International Preliminary Report on Patentability, dated Oct. 30, 2018.

Scania CV AB, European Application No. 17790010.7, Extended European Search Report, dated Oct. 8, 2019.

* cited by examiner

VALVE DRIVE

CROSS-REFERENCE TO RELATED APPLICATIONS

This application is a national stage application (filed under 35 § U.S.C. 371) of PCT/SE2017/050354, filed Apr. 11, 2017 of the same title, which, in turn, claims priority to Swedish Application No. 1650568-7, filed Apr. 28, 2016; the contents of each of which are hereby incorporated by reference.

FIELD OF THE INVENTION

The present invention relates to a valve drive for use in an internal combustion engine.

BACKGROUND OF THE INVENTION

A valve drive of the type defined in the introduction is known through for example US 2010/0251982 A1. In spite of the fact that that valve drive may function well it would be beneficial to simplify and improve the construction of such a valve drive not at least with respect to reliability.

SUMMARY OF THE INVENTION

The object of the present invention is to provide a valve drive of the type defined in the introduction being improved in at least some aspect with respect to such valve drives already known.

This object is according to the invention obtained by providing a valve drive comprising a camshaft with a base shaft configured to rotate about a longitudinal axis, a lobe pack mounted on the base shaft and comprising at least two differently shaped cam lobes, two actuator bodies associated with two actuator pins, in which each pin is connected to a valve of a cylinder of the engine and each actuator body is configured to be moved when hit by a said cam lobe aligned therewith and by that lift at least one said valve between a closed and open positions, and an arrangement controllable to displace the lobe pack axially along the base shaft so as to for each actuator body change cam lobe aligned therewith.

By such a construction of the valve drive a type of valve actuation with a lobe pack in said first position may be changed to another type of valve actuation by displacing the lobe pack to said second position, and when changing the type selected the other type may in the same instant be deactivated by aligning the actuator body for that type with said middle cam lobe. Furthermore, by having the middle cam lobe in common to both actuator bodies the construction of the valve drive will be simpler, less costly to manufacture and requiring less space than would one separate "zero cam lobe" be arranged for each actuator body.

According to an embodiment of the invention said first actuator body and first cam lobe are configured to co-operate to lift at least one valve to an open position located at a different distance to the closed position of that valve than the distance to the closed position of the open position to which the second actuator body and the third cam lobe are configured to lift a valve. This means that the operation of the cylinder provided with the valve drive may be controlled to change by moving the lobe pack between the first and second positions, since the height to which at least one valve is lifted will by that be changed. However, it is of course also possible to have the cam lobes so arranged that then also the position in the operation cycle of the cylinder for the lifting of the valve will be changed by changing actuator body to be acted upon.

According to another embodiment of the invention the first and third cam lobes are differently shaped and their surface to bear upon the respective actuator body have a different maximum distance to said longitudinal axis. A modified behavior and operation of the valve drive and by that the cylinder of the engine associated therewith by changing which one of these cam lobes to be active, i.e. to have an actuator body aligned therewith, will be possible to obtain by such differently shaping of the cam lobes.

According to another embodiment of the invention said first actuator body is associated with both actuator pins so as to lift both valves when aligned with said first cam lobe. Thus, the operation of the valve drive may be changed by having both valves lifted in said first position of the lobe pack, while only one valve is lifted in said second position of the lobe pack by having the second actuator body associated with one actuator pin so as to lift only one valve when aligned with said third cam lobe in accordance with another embodiment of the invention. Already the fact that one valve is lifted instead of both will result in a different operation of the cylinder of the engine, but there may also be a difference to which height the valves are lifted and where in the operation cycle of the cylinder the valves are lifted.

According to another embodiment of the invention the actuator bodies are configured to lift exhaust valves of a cylinder of the internal combustion engine. It is in such a case advantageous, as defined in another embodiment of the invention, that the second actuator body is in the second position of the lobe pack configured to be hit and moved by said third cam lobe close to the upper dead point of a piston of the cylinder in the compression stroke of that cylinder so as to act as a Compression Release Brake. This constitutes an advantageous way of realizing such a CRB, which normally is realized by an hydraulic system activating an actuator body in the form of a rocker lever by filling a cylinder with oil. However, it would be beneficial to at the same time deactivate the normal lift of the exhaust valves for obtaining best possible efficiency of the compression release brake, and this is here obtained by having the first actuator body aligned with the middle cam lobe when activating the CRB.

According to another embodiment of the invention the second actuator body is in the second position of the lobe pack configured to be hit and moved by said third cam lobe close to the upper dead point of a piston of the cylinder also in the exhaust stroke of that cylinder so as to act as a compression release brake. Thanks to the fact that the normal lift of the valves during normal combustion of the engine is deactivated by the alignment of the first actuator body with the middle lobe it will be possible to in this way get brake compressions each time the piston come to the upper dead point, so that the brake will be a two stroke brake in spite of the fact that the operation cycle of the engine has four strokes.

According to another embodiment of the invention constituting a further development of the embodiment last mentioned said distance between the closed and open position is shorter for the second actuator body associated with the compression release brake than for the first actuator body.

According to another embodiment of the invention the arrangement is configured to displace the lobe pack to assume said first position so as to obtain lifting of both valves by said first actuator body during normal combustion of the engine. Thus, a preferred operation of the engine for propulsion of a vehicle may be obtained in the first position by controlling both valves.

According to another embodiment of the invention said arrangement is configured to displace the lobe pack to assume said second position so as to only have a second valve lifted by the third cam lobe acting on said second actuator body so as to obtain braking of the engine by a compression release brake. It is advantageous to activate only one valve when braking by the compression release brake, since this will result in lower loads in the drive train compared to activating two valves.

According to another embodiment of the invention the actuator bodies are configured to lift inlet valves of a cylinder of the internal combustion engine. A valve drive according to the invention may then for instance be used for being able to change the flow of gases in the cylinder at certain types of operation of the engine.

According to another embodiment of the invention the middle cam lobe has a width as seen in the axial direction of the camshaft allowing both actuator bodies to be simultaneously aligned therewith, and said arrangement is controllable to displace the lobe pack along the base shaft to a third middle position between said first and second positions in which both actuator bodies are aligned with said middle cam lobe leaving them and by that both valves uninfluenced thereby by rotation of the camshaft. This feature makes it possible to completely switch off a cylinder of the engine when desired for any reason.

The invention also relates to an internal combustion engine and a motor vehicle according to the appended claims directed thereto.

Such valve drives are primarily of interest for internal combustion engines in motor vehicles, although the invention is not restricted to that use of such an engine. When arranged in a motor vehicle such a valve drive and accordingly the present invention is particularly applicable to heavy wheeled motor vehicles, such as trucks or lorries and buses, and the invention will for that sake hereinafter primarily be discussed for that field of use for illuminating the invention but accordingly not in any way restrict it thereto.

The fuel used in such an engine may be of any conceivable type and diesel and ethanol may be mentioned as examples.

There may be different reasons for providing for a possibility to displace the lobe pack of such a valve drive for changing the control of valves, exhaust valves or inlet valves, of the engine. Such reasons may be to minimize emissions, increase efficiency, speed control of a vehicle, braking the vehicle etc.

Other advantageous features as well as advantages of the present invention appear from the description following below.

BRIEF DESCRIPTION OF THE DRAWING

With reference to the appended drawing, below follows a specific description of an embodiment of the invention cited as an example. In the drawing.

DETAILED DESCRIPTION OF THE INVENTION

Figure 1:
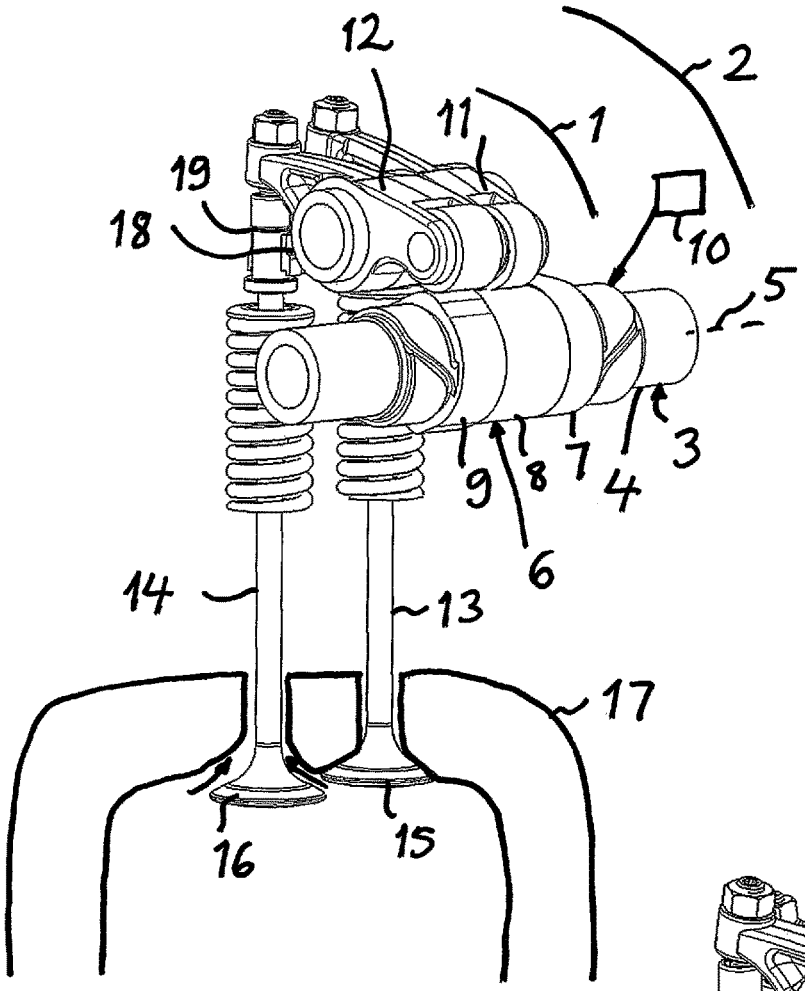
FIGS. 1 and 2 are schematic views illustrating parts of an internal combustion engine provided with a valve drive according to an embodiment of the invention.
Figure 2:
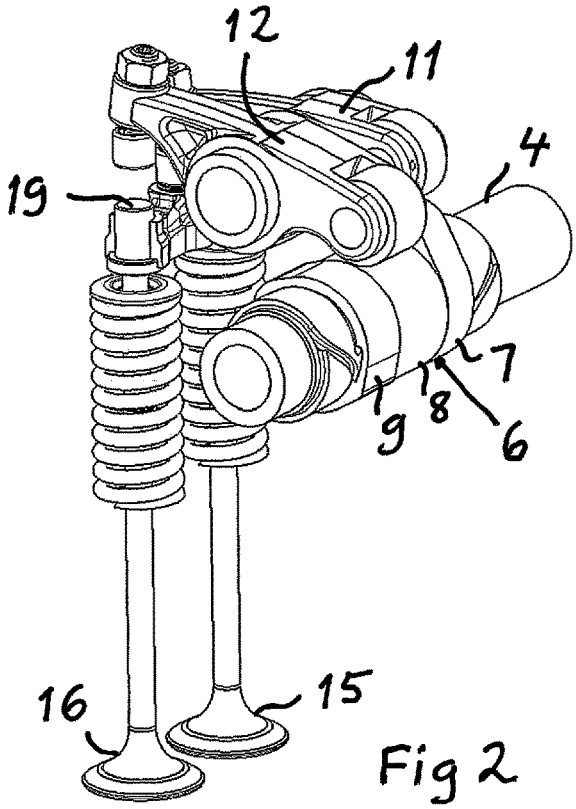

The construction and function of a valve drive according to an embodiment of the invention of an internal combustion engine 1 in a motor vehicle 2 will now be disclosed while referring to FIGS. 1 and 2. The engine has a camshaft 3 with a base shaft 4 configured to rotate about a longitudinal axis 5. A lobe pack 6 provided with three consecutive lobes 7-9 is mounted on the base shaft 4, and an arrangement 10 controllable to displace the lobe pack axially along the base shaft is indicated by a box 10 in FIG. 1 and may be of any conceivable type and controllable by the driver of the vehicle or by an electronic control unit of the vehicle based upon the value of certain parameters sensed.

The valve drive further comprises two actuator bodies 11, 12 in the form of valve rocker levers associated with two actuator pins 13, 14 each connected to a valve 15, 16, which are here assumed to be exhaust valves of a cylinder 17 of the engine 1.

The actuator body 11 is acting upon a valve bridge 18 pressing on both valve pins 13, 14, whereas the second actuator body 12 acts directly on the valve pin 14 through a through-hole 19 in the bridge 18. This is possible since the valve pin 14 is at the valve remote end divided in two parts.

The lobe pack 6 is transferrable through said arrangement between two positions, namely a first position in which the first actuator body 11 is aligned with and hit and moved by a first 7 of the cam lobes by rotation of the camshaft (see FIG. 2), and a second position, in which the second actuator body 12 is aligned with and hit and moved by a third cam lobe 9 by rotation of the camshaft. The second, middle cam lobe 8 has a shape leaving an actuator body aligned therewith uninfluenced thereby by rotation of the camshaft, and this middle cam lobe is in common to both actuator bodies, so that the second actuator body 12 will be aligned therewith in said first position shown in FIG. 2 and the first actuator body 11 will be aligned therewith in the second position shown in FIG. 1.

The function of the valve drive will be as follows. During normal drive of the internal combustion engine and by that of the motor vehicle for propulsion thereof the lobe pack 6 is kept in the first position shown in FIG. 2, which means that the first actuator body is aligned with the first cam lobe 7 for "lifting" both exhaust valves 15, 16 for letting exhaust gases out of the cylinder resulting in a most efficient propulsion of the vehicle. "Lifting" is as seen in the figures in fact a pressing or pushing of the valves 15, 16 down into the cylinder so as to allow exhaust gases to pass the valves.

In the case using the compression release brake of the valve drive the arrangement 10 is controlled to displace the lobe pack 6 to the position shown in FIG. 1, i.e. said second position, in which the second actuator body 12 is aligned with the third cam lobe 9 and the first actuator body 11 is aligned with the middle cam lobe 8. This means that only the valve 16 will be influenced by rotation of the camshaft, and the cam lobe 9 will preferably be designed to co-operate with the actuator body 12 so that the valve 16 will be pressed down into the cylinder close to the upper dead point of a piston of the cylinder in the compression stroke of that cylinder, so that air compressed in the cylinder is released and no energy is returned to the crank shaft of the engine. Energy is instead absorbed and the torque to rotate the crank shaft will increase and the engine brake. It is also possible to design the second actuator body 12 and the third cam lobe 9 to co-operate so as to bring the exhaust valve 16 to open earlier, so that it may be open during the expansion stroke and by that let an over pressure from the exhaust side into the cylinder, so that this earlier opening of the exhaust valve will then result in an earlier closing of the valve during the exhaust stroke, which results in an additional compression stroke in the operation cycle of the piston and the braking of the engine increases.

The second position shown in FIG. 1 may except for braking the vehicle be chosen for obtaining hotter exhaust gases for increasing the temperature and efficiency of a cold catalytic converter of the vehicle or assisting a vehicle cruise control to keep a constant speed of the vehicle when driving an undulating downhill road path.

The invention is of course in no way restricted to the embodiment described above, since many possibilities to modifications thereof are likely to be obvious to one skilled in the art without having to deviate from the scope of invention defined in the appended claims.

It is possible to control only one, some or all cylinders of an engine by a valve drive according to the invention.

The invention claimed is:

1. A valve drive for use in an internal combustion engine comprising:

a camshaft comprising:

a base shaft configured to rotate about a longitudinal axis; and a lobe pack mounted on said base shaft and comprising a first, a second, and a third respective cam lobe, where each cam lobe is differently shaped from each of said other cam lobes; and first and second actuator bodies each associated with respective actuator pins, where each actuator pin is connected to a respective valve of a cylinder of the internal combustion engine and said first and second actuator bodies are configured to be moved when contacted by one of said first and third cam lobes aligned therewith and, which contact thereby lifts the valve associated with said first or second actuator body from a closed position to an open position, wherein said second cam lobe of said lobe pack is located between said first and third cam lobes and has a shape that does not move said first or second actuator bodies when aligned therewith via rotation of said camshaft, and that said second cam lobe is in common to both first and second actuator bodies, and wherein said lobe pack is configured to be axially moveable along said base shaft between a first position, in which said first actuator body is aligned with and contacted by said first cam lobe via rotation of said camshaft and said second actuator body is aligned with said second cam lobe, and a second position, in which said second actuator body is aligned with and contacted by said third cam lobe via rotation of said camshaft and said first actuator body is aligned with said second cam lobe.

2. The valve drive according to claim 1, wherein said first actuator body and said first cam lobe are configured to co-operate to lift the valve associated with said first actuator body to the open position, where such open position is located at a different distance to the closed position of that the valve than a distance to the closed position of the open position to which said second actuator body and said third cam lobe are configured to lift the valve associated with said second actuator body.

3. The valve drive according to claim 2, wherein said first and third cam lobes are differently shaped and have respective surfaces configured to bear upon said respective first and second actuator bodies that have a different maximum distance to said longitudinal axis of said base shaft.

4. The valve drive according to claim 1, wherein said first actuator body is associated with two of said actuator pins so as to lift the respective valve associated with each of said two actuator pins when said first actuator body is aligned with said first cam lobe.

5. The valve drive according to claim 4, wherein said second actuator body lifts the valve associated with said actuator body when said second actuator body is aligned with said third cam lobe.

6. The valve drive according to claim 1, wherein the valves associated respectively with the first and second actuator bodies are exhaust valves and said first and second actuator bodies are configured to lift said exhaust valves.

7. The valve drive according to claim 6, wherein said second actuator body is in the second position of the lobe pack and is configured to be contacted and moved by said third cam lobe at a position close to an upper dead point of a piston in the cylinder in a compression stroke of that cylinder so as to act as a compression release brake.

8. The valve drive according to claim 7, wherein said second actuator body is associated with one of said actuator pins to lift the valve associated with said actuator pin when aligned with said third cam lobe, and wherein said second actuator body is, in the second position of the lobe pack, configured to be contacted and moved by said third cam lobe at a position close to the upper dead point of the piston of the cylinder also in an exhaust stroke of that cylinder so as to act as the compression release brake.

9. A valve drive according to claim 8, wherein said first actuator body and said first cam lobe are configured to co-operate to lift the valve associated with said first actuator body to the open position, where such open position is located at a different distance to the closed position of that the valve than a distance to the closed position of the open position to which said second actuator body and said third cam lobe are configured to lift the valve associated with said second actuator body, wherein said distance between the closed and open position is shorter for the valve associated with said second actuator body associated with the compression release brake than for the valve associated with said first actuator body.

10. A valve drive according to claim 9, wherein said second actuator body lifts the valve associated with said actuator body when aligned with said third cam lobe, and wherein said second actuator body is, in the second position of the lobe pack, configured to be contacted and moved by said third cam lobe at a position close to the upper dead point of the piston of the cylinder also in the exhaust stroke of that cylinder so as to act as the compression release brake.

11. The valve drive according to claim 7, wherein said first actuator body and said first cam lobe are configured to co-operate to lift the valve associated with said first actuator body to the open position, where such open position is located at a different distance to the closed position of that the valve than a distance to the closed position of the open position to which said second actuator body and said third cam lobe are configured to lift the valve associated with said second actuator body, wherein said distance between the closed and open position is shorter for the valve associated with said second actuator body associated with the compression release brake than for the valve associated with said first actuator body.

12. The valve drive according to claim 7, wherein said first actuator body is associated with two of said actuator pins so as to lift the respective valve associated with each of said two actuator pins when said first actuator body is aligned with said first cam lobe, and wherein, during normal combustion of the internal combustion engine, the lobe pack is in said first position so as to obtain lifting of the respective valve associated with said two actuator pins by said first actuator body.

13. The valve drive according to claim 7, wherein said second actuator body lifts the valve associated with said actuator pin when aligned with said third cam lobe, and wherein, to obtain braking of the engine by the compression release brake, said lobe pack is located in the second position so that said third cam lobe contacts said second actuator body and thereby lifts the valve associated with said second actuator body.

14. The valve drive according to claim 1, wherein the valves associated respectively with the first and second actuator bodies are inlet valves and said first and second actuator bodies are configured to lift said inlet valves.

15. The valve drive according to claim 1, wherein the second cam lobe has a width as seen in an axial direction of the camshaft allowing both first and second actuator bodies to be simultaneously aligned therewith, and that said lobe pack is positionable along the base shaft to a third middle position between said first and second positions in which both said first and second actuator bodies are aligned with said second cam lobe.

16. An internal combustion engine including a valve drive for use with the internal combustion engine, wherein said valve drive comprises:

a camshaft comprising:

a base shaft configured to rotate about a longitudinal axis; and a lobe pack mounted on said base shaft and comprising a first, a second, and a third respective cam lobe, where each cam lobe is differently shaped from each of said other cam lobes; and first and second actuator bodies each associated with respective actuator pins, where each actuator pin is connected to a respective valve of a cylinder of the internal combustion engine and said first and second actuator bodies are configured to be moved when contacted by one of said first and third cam lobes aligned therewith and, which contact thereby lifts the valve associated with said first or second actuator body from a closed position to an open position, wherein said second cam lobe of said lobe pack is located between said first and third cam lobes and has a shape that does not move said first or second actuator bodies when aligned therewith via rotation of said camshaft, and that said second cam lobe is in common to both first and second actuator bodies, and wherein said lobe pack is configured to be axially moveable along said base shaft between a first position, in which said first actuator body is aligned with and contacted by said first cam lobe via rotation of said camshaft and said second actuator body is aligned with said second cam lobe, and a second position, in which said second actuator body is aligned with and contacted by said third cam lobe via rotation of said camshaft and said first actuator body is aligned with said second cam lobe.

17. A motor vehicle including an internal combustion engine and a valve drive for use with the internal combustion engine, wherein said valve drive comprises:

a camshaft comprising:

a base shaft configured to rotate about a longitudinal axis; and a lobe pack mounted on said base shaft and comprising a first, a second, and a third respective cam lobe, where each cam lobe is differently shaped from each of said other cam lobes; and first and second actuator bodies each associated with respective actuator pins, where each actuator pin is connected to a respective valve of a cylinder of the internal combustion engine and said first and second actuator bodies are configured to be moved when contacted by one of said first and third cam lobes aligned therewith and, which contact thereby lifts the valve associated with said first or second actuator body from a closed position to an open position, wherein said second cam lobe of said lobe pack is located between said first and third cam lobes and has a shape that does not move said first or second actuator bodies when aligned therewith via rotation of said camshaft, and that said second cam lobe is in common to both first and second actuator bodies, and wherein said lobe pack is configured to be axially moveable along said base shaft between a first position, in which said first actuator body is aligned with and contacted by said first cam lobe via rotation of said camshaft and said second actuator body is aligned with said second cam lobe, and a second position, in which said second actuator body is aligned with and contacted by said third cam lobe via rotation of said camshaft and said first actuator body is aligned with said second cam lobe.

* * * * *